United States Patent [19]

Szabo

[11] Patent Number: 4,795,163

[45] Date of Patent: Jan. 3, 1989

[54] VOLLEYBALL PASSING TRAINER

[76] Inventor: Gerald S. Szabo, 806 Broadfield Dr., Newark, Del. 19713

[21] Appl. No.: 29,064

[22] Filed: May 19, 1987

[51] Int. Cl.[4] ..... A63B 67/00; A63B 67/18; A63B 69/00

[52] U.S. Cl. ..... 273/411; 434/247

[58] Field of Search ..... 434/247, 258; 273/411, 273/54 B, 118 A, 118 R; 272/117, 143, 134

[56] References Cited

U.S. PATENT DOCUMENTS

| | | | |
|---|---|---|---|
| 4,372,561 | 2/1983 | Morgan et al. | 273/411 |
| 4,537,394 | 8/1985 | Golinsky, Jr. | 272/117 |
| 4,575,089 | 3/1986 | Corbett et al. | 273/189 A |

FOREIGN PATENT DOCUMENTS

| | | | |
|---|---|---|---|
| 2807743 | 9/1979 | Fed. Rep. of Germany | 273/411 |
| 636000 | 12/1978 | U.S.S.R. | 273/411 |
| 1000038 | 2/1983 | U.S.S.R. | 273/411 |
| 1001946 | 3/1983 | U.S.S.R. | 273/411 |

*Primary Examiner*—Richard C. Pinkham
*Assistant Examiner*—Mark S. Graham

[57] ABSTRACT

The champion perfect passer is an instructional device used to teach the skill of the forearm bump pass for the sport of volleyball.

The passer is used by placing the fixed sleeves on the users biceps, and reaching the hands forward to grasp the moveable ball with thumbs together on top of the ball and rolling them over to a position where they contact the rod at its front with the tips of the thumbs. Fingers on both hands are clasped under the rod and pull up against the rod. This causes the arms to assume the proper passing position, and will not allow for the elbows to bend which is the most difficult bad habit to break in volleyball. All normal volleyball bump passing drills are completed with the passer in place and the student is taught proper form and body position.

1 Claim, 5 Drawing Sheets

VOLLEYBALL PASSING TRAINER

BACKGROUND OF THE INVENTION

The most difficult and time consuming skill to learn in the sport of volleyball is the forearm pass. The most frequent problems in learning this skill are that individuals being taught, want to strike the ball rather than merely absorbing and redirecting the power already present. They also want to bend the elbows to adjust the arm position to the ball and they do not keep their hands steady with their thumbs pressed downwards. The device of the present invention is designed to teach individual proper form when attempting a forearm pass.

Briefly the present invention is directed at a device which comprises an armrest connected to a bent shaft. These parts may be made integral and could be considered one unit. A hand-grasp is attached to the part of the shaft distal from the armrest and is movable along the shaft. The mobility of the hand-grasp allows for individuals having different arm lengths to use the same device with no major adjustments.

DETAILED DESCRIPTION OF THE DRAWINGS

Figure 1:
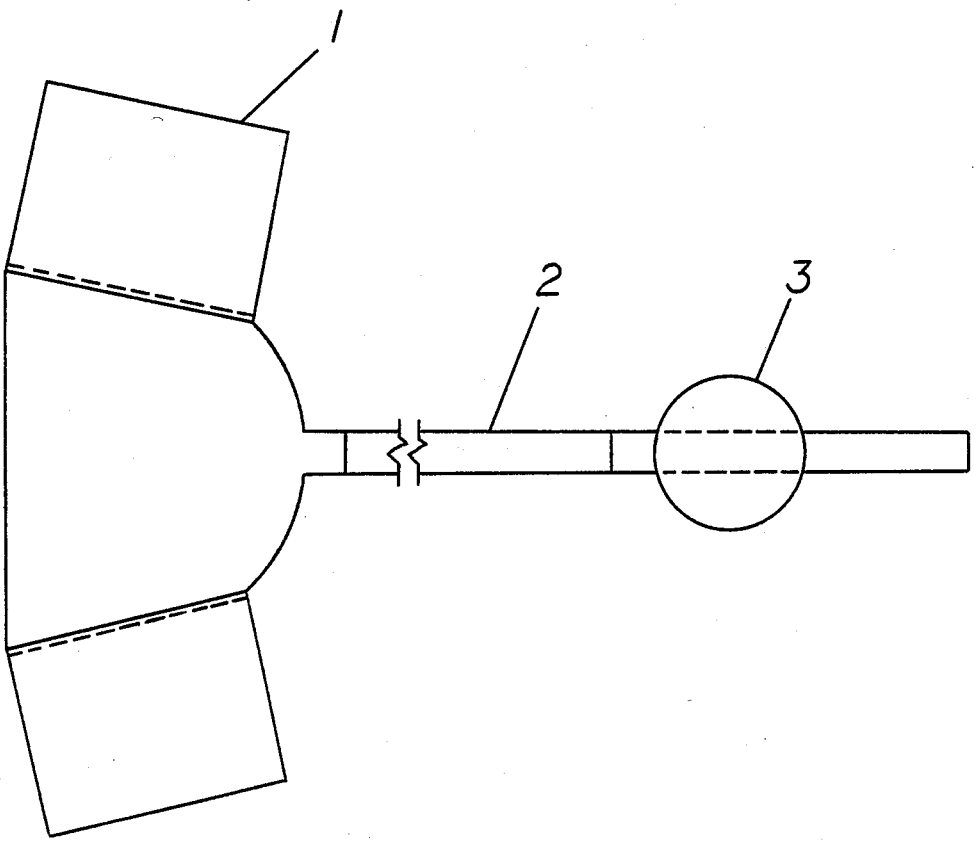
FIG. 1 is a top view of the passer.
Figure 2:
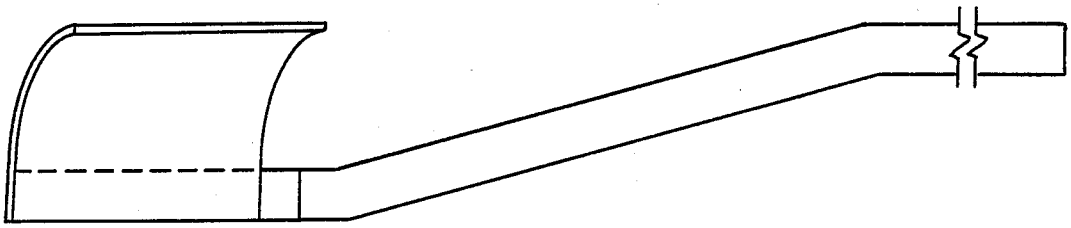
FIG. 2 is a side view of the device with the arm rests on the left and bent shafts extending towards the right.
Figure 3:
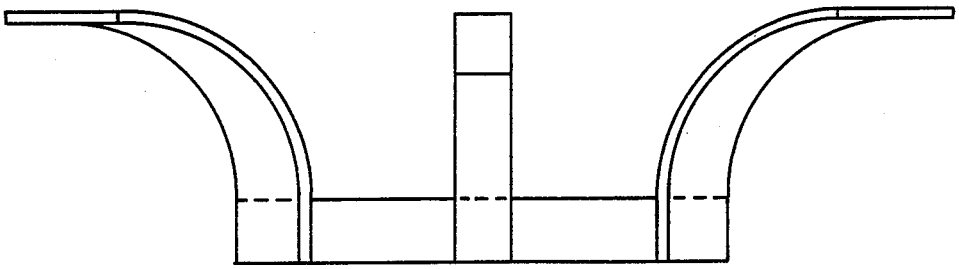
FIG. 3 is an end view of the device as seen from the right side of FIG. 2.
Figure 4:
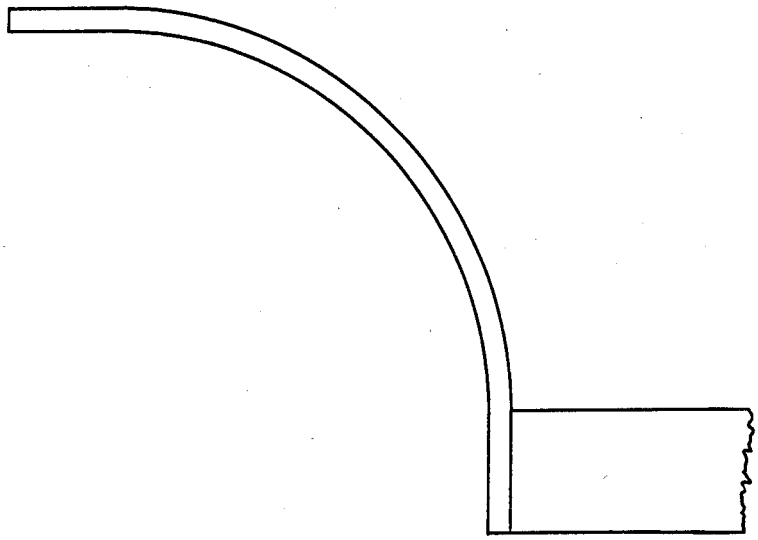
FIG. 4 is a view of one half of the arm rest.
Figure 5:
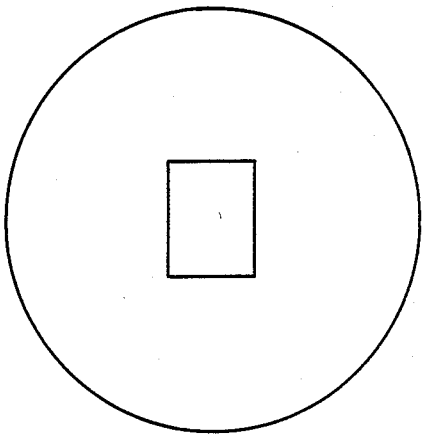
FIG. 5 is a view of the movable hand-grasp.
Figure 6:
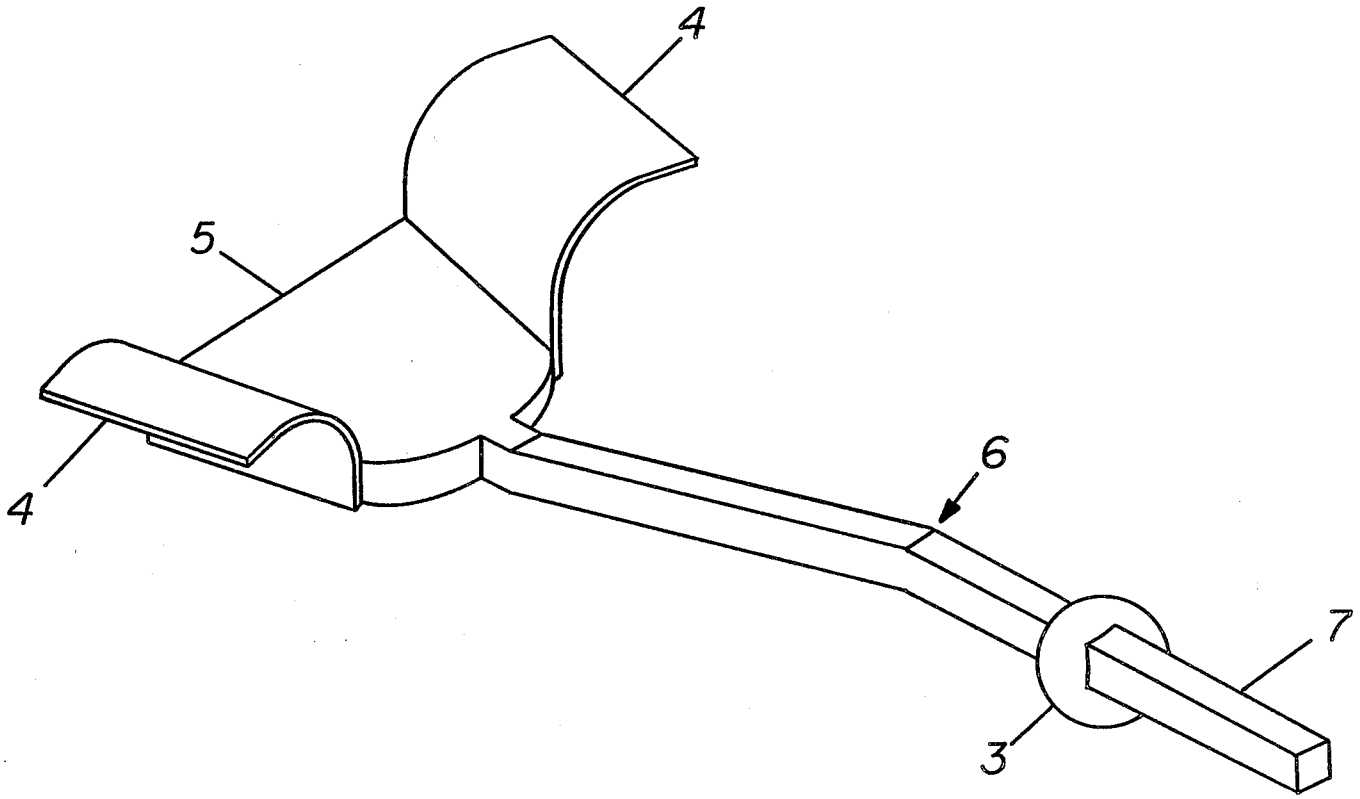
FIG. 6 is a perspective view of the passer.

Referring now to FIG. 1 the passer includes an armrest portion 1 connected to elongated shaft 2. A hand-grasp 3 shaped like a ball is attached to the shaft such that it is movable therealong. As can be seen in FIG. 6 the armrest portion is comprised of a horizontal end plate 5 and a pair of laterally extending sleeves 4. The shaft 2 contains a bend 6, and the distal end of the shaft extends in a plane which is substantially parallel to the end plate 5.

The passer is used by placing the sleeves 4 of the armrest on the individual's biceps and having the individual grasp the hand-grasp 3 with the hands such that the thumbs are together on top of the hand-grasp ball. The thumbs are forced forward until the thumb tips touch the distal end of the shaft 7 in front of the hand-grasp. The hands and fingers grasp the ball with the forefingers locked under the distal end of the shaft 7 in front of the ball.

By proper positioning of the passer as explained the individual completes all normal passing drills. The passer allows the arm position to be perfected so that the individual learns proper feel of arm position and is forced to move the body to the ball rather than swinging the arms to make adjustments. This forces proper footwork.

The bend 6 as shown in FIG. 6 serves a dual purpose; as a stop for handgrasp 3; and more importantly as an immediate alert when the thumbs are not in the proper position. When the thumbs are wrong the ball will strike the bend 6, and the shock of the contact will be felt in the hands and will also be transmitted to the armrest position 1 by the shaft 2.

The armrest 1; shaft 2; and hand-grasp 3, as a unit together, teach proper form and stop elbow flex, thumb flex and arm swing. The bend 6 alerts the individual as to improper contact surface by shock to the shaft. The combined elements of the passer eliminate the four most common passing mistakes.

I claim:

1. A volleyball bump pass training device comprising a substantially horizontal end plate, said end plate having a pair of opposite laterally extending means to engage and rest upon the biceps of a player; a center shaft with a proximal end connected to said end plate and extending longitudinally and upwards therefrom; a member extending substantially horizontally from the distal end of said shaft and ball grasp means longitudinally slidably connected to said member.

* * * * *